US008439293B2

(12) United States Patent
Hagleitner

(10) Patent No.: US 8,439,293 B2
(45) Date of Patent: May 14, 2013

(54) PAPER DISPENSER

(76) Inventor: Hans Georg Hagleitner, Zell Am See (AT)

( * ) Notice: Subject to any disclaimer, the term of this patent is extended or adjusted under 35 U.S.C. 154(b) by 73 days.

(21) Appl. No.: 12/940,352

(22) Filed: Nov. 5, 2010

(65) Prior Publication Data

US 2011/0042503 A1 Feb. 24, 2011

Related U.S. Application Data

(63) Continuation of application No. PCT/AT2009/000142, filed on Apr. 8, 2009.

(30) Foreign Application Priority Data

May 5, 2008 (AT) ..... 711/2008

(51) Int. Cl.
*B65H 19/00* (2006.01)

(52) U.S. Cl.
USPC ..... 242/560.3; 242/561

(58) Field of Classification Search ..... 242/558, 242/559, 559.1, 559.3, 559.4, 560, 560.1, 242/560.2, 560.3, 561, 598.6
See application file for complete search history.

(56) References Cited

U.S. PATENT DOCUMENTS

| | | | | |
|---|---|---|---|---|
| 3,865,295 | A | 2/1975 | Okamura | |
| 4,307,638 | A | 12/1981 | DeLuca et al. | |
| 4,552,315 | A | 11/1985 | Granger | |
| 4,844,361 | A | 7/1989 | Granger | |
| 4,944,466 | A | 7/1990 | Jespersen | |
| 5,288,032 | A * | 2/1994 | Boone et al. | 242/560.3 |
| 5,558,302 | A * | 9/1996 | Jesperson | 242/560 |
| 7,338,007 | B2 * | 3/2008 | Valot | 242/559 |
| 7,980,506 | B2 * | 7/2011 | Kling et al. | 242/560 |

FOREIGN PATENT DOCUMENTS

| | | | |
|---|---|---|---|
| EP | 0116508 | A1 | 8/1984 |
| EP | 0206952 | A1 | 12/1986 |
| EP | 0351187 | A2 | 1/1990 |
| WO | 2009135235 | A2 | 11/2009 |

OTHER PUBLICATIONS

International Search Report dated Apr. 1, 2010.

* cited by examiner

*Primary Examiner* — William A Rivera
(74) *Attorney, Agent, or Firm* — Laurence A. Greenberg; Werner H. Stemer; Ralph E. Locher

(57) ABSTRACT

A dispenser for dispensing paper from a dispensing roll located in a lower dispensing position has a guide track which leads from the top into the lower dispensing position and in which a standby position, defined by a blocking device, for a reserve roll is provided. The dispenser further has a device for detecting a diameter of the dispensing roll and a device for releasing the blocking device for the reserve roll once the paper on the dispensing roll has been used up. The diameter of the dispensing roll is detected by a sensing element which pushes against the circumferential surface of the dispensing roll, is displaced by the dropping reserve roll and returns to its sensing position once the reserve roll has dropped.

8 Claims, 3 Drawing Sheets

PAPER DISPENSER

CROSS-REFERENCE TO RELATED APPLICATION

This is a continuation application, under 35 U.S.C. §120, of copending international application No. PCT/AT2009/000142, filed Apr. 8, 2009, which designated the United States; this application also claims the priority, under 35 U.S.C. §119, of Austrian patent application No. A 711/2008, filed May 5, 2008; the prior applications are herewith incorporated by reference in their entirety.

BACKGROUND OF THE INVENTION

Field of the Invention

The invention relates to a dispenser for dispensing paper from a dispensing roll located in a lower dispensing position, having a guide track which leads from the top into the dispensing position and in which a standby position, defined by a blocking device, for a reserve roll is provided. The dispenser further has a device for detecting the diameter of the dispensing roll and a device for releasing the blocking device for the reserve roll once the paper on the dispensing roll has been used up.

A dispenser of this kind is disclosed, for example, in U.S. Pat. No. 4,844,361. In the case of this dispenser the guide track ends in the dispensing position and is open downward, and so the dispensing roll rests on a conveying roller. The dispensing roll carrier is additionally held and/or guided by a pivoting lever, from which the carrier can also exit freely in the downward direction. Once the paper on the dispensing roll has been used up, the pivoting lever has moved so far downward that the blocking device for the reserve roll is unlocked and pivoted downward by the reserve roll, which is moving under the force of gravity. This pivoting movement of the blocking device guides the pivoting lever upward, the empty carrier is freed and drops out of the guide track. Before the reserve roll arrives in the dispensing position, the blocking device for its part is freed from the roll and the upwardly guided pivoting lever grips the reserve roll carrier. The blocking device returns to the blocking position, and so a new reserve roll can be inserted. A plurality of springs and levers are provided overall for this purpose. One disadvantage of this dispenser is that the paper outlet slot is very close to the rear wall, and so the paper cannot be grasped particularly easily. A further disadvantage is that the roll carrier has to be coordinated with the pivoting lever, which triggers the blocking device, and this severely restricts the design possibilities.

SUMMARY OF THE INVENTION

It is accordingly an object of the invention to provide a paper dispenser which overcomes the above-mentioned disadvantages of the prior art devices of this general type, in which the paper is held ready for removal, at a large distance from the wall, and of which the roll carrier ends, which protrude into the guide tracks, do not have to be coordinated with the sensing and roll-changing mechanism. With the foregoing and other objects in view there is provided, in accordance with the invention a dispenser for dispensing paper from a dispensing roll located in a lower dispensing position. The dispenser containing a blocking device, a guide track which leads from a top into the lower dispensing position and in which a standby position, defined by the blocking device, for a reserve roll is provided, a device for releasing the blocking device for the reserve roll once the paper on the dispensing roll has been used up, and a device for detecting a diameter of the dispensing roll and having a sensing element resting against a circumferential surface of the dispensing roll. The sensing element can be displaced by dropping the reserve roll and returns to a sensing position once the reserve roll has dropped.

According to the invention, this is achieved in that the device for detecting the diameter of the dispensing roll has a sensing element which rests against the circumferential surface of the dispensing roll, can be displaced by the dropping reserve roll and returns to the sensing position once the reserve roll has dropped.

A sensing element which does not roll on the circumferential surface of the paper roll has to be arranged such that the bearing edge does not damage the paper. The sensing element therefore has to rest with dragging action on the paper. If the sensing element is mounted in a pivotable manner, the sensing element has to extend from the pivot axis in the direction of rotation of the roll, i.e. every point of the paper roll first of all passes the pivot axis and only then passes the bearing edge of the sensing element.

Frequently, the paper is printed on one side and the printed side is always on the outside in the case of a paper roll because otherwise it cannot be seen. If the dispenser is also intended to accommodate printed paper, the printed side has to be visible to the user at that end of the paper strip which protrudes out of the dispenser. Therefore, not only does care have to be taken with regard to inserting the rolls on the right side, which need not be discussed any further here, but also the paper dispenser has to be configured such that the sensing element is in a position which allows the use of rolls of printed paper in the desired manner. A sensing element which rests with dragging action on printed paper therefore has to be arranged in the housing at the front and above the roll to be measured, if the sensing element is not intended to be pushed upward by springs.

In a preferred embodiment, the dispenser is also suitable for printed paper if the sensing element is arranged on a bracket which is mounted in a pivotable manner above the dispensing roll and of which the side parts are two-armed levers, wherein each first lever arm protrudes into the guide track. As a result, the dropping roll pivots each of the two side parts such that the first lever arms are entrained downward by the ends of the roll carrier, which protrude into the guide track, and the second lever arms, which move the sensing element, are pivoted upward, and so the sensing element moves out of the way of the roll. The length of the first lever arms is chosen such that they are released again by the dropping roll before the latter had reached the dispensing position, and so the bracket pivots downward again until it rests with dragging action on the roll.

In order that the blocking device for the reserve roll are released only when the dispensing roll has been used up, the pivoting movement of the sensing element is transmitted to the blocking device only in the final portion of its path.

This can be achieved in particular by arranging on each first lever arm a pin which engages in a curved slot in the blocking device, a first portion of the slot extending concentrically with respect to the pivot axis of the sensing element and a subsequent, second portion extending eccentrically with respect thereto.

In order to remove the roll carrier of the used-up dispensing roll, it is furthermore preferably provided that a second, releasable blocking device is provided for the dispensing position of the dispensing roll and interacts with the two first lever arms.

In the case of the dispenser according to the invention, gravity is used to displace and return the sensing element. However, the dropping roll can also be used as a drive or trigger for other processes specific to the dispenser, for example for activating an external indicator for a roll change.

Other features which are considered as characteristic for the invention are set forth in the appended claims.

Although the invention is illustrated and described herein as embodied in a paper dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
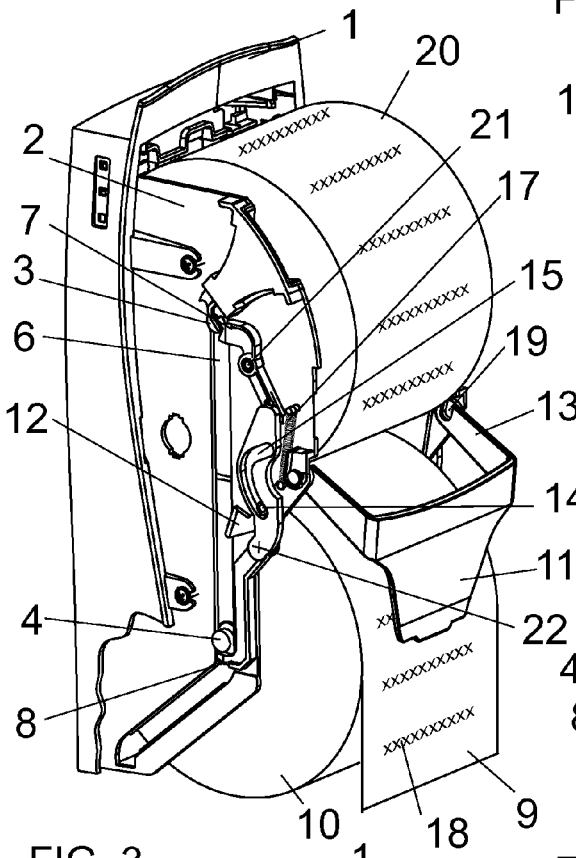
FIG. 1 is a perspective view of a dispenser in a first position during use according to the invention.
Figure 10:
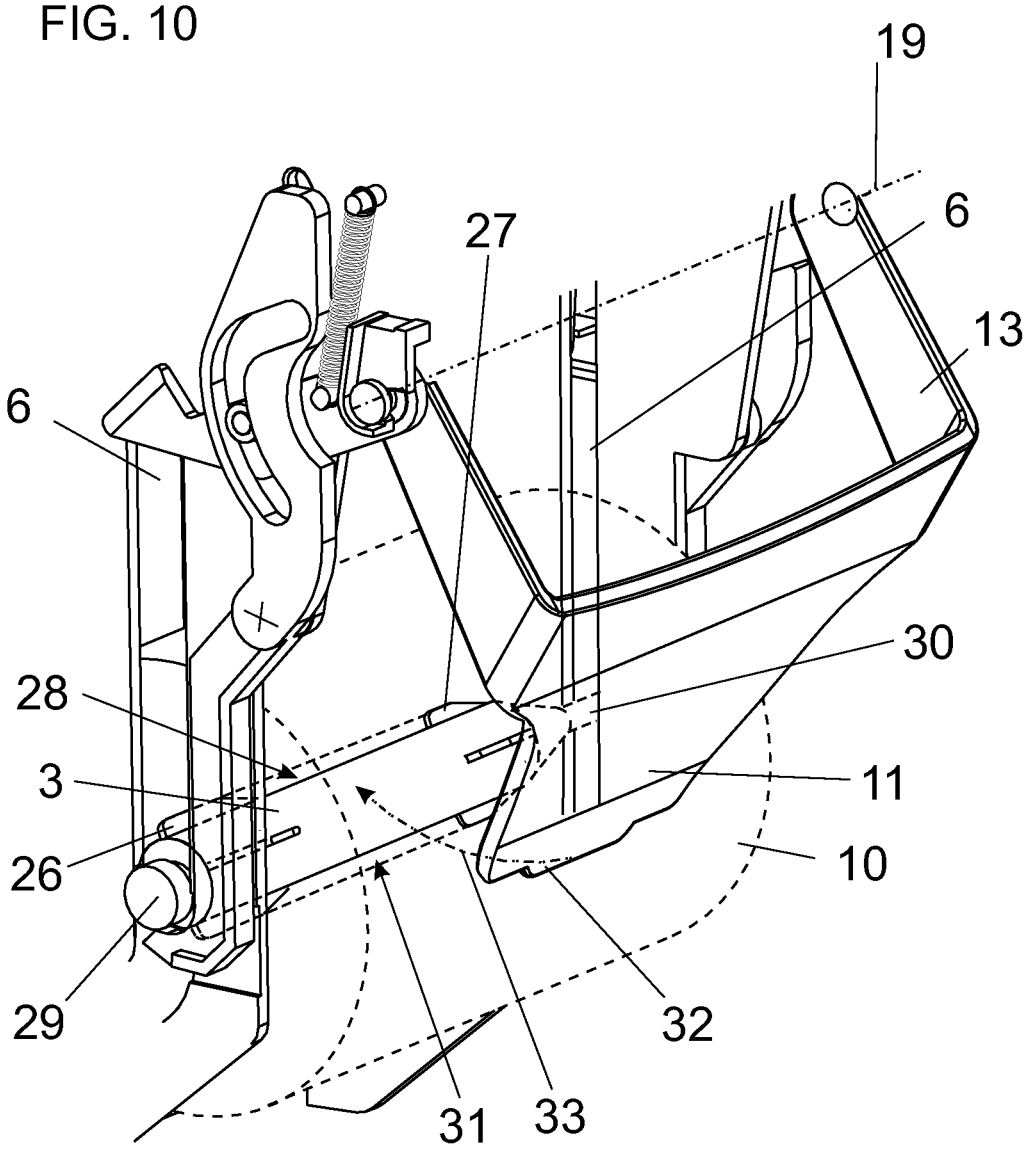
FIG. 10 is a diagrammatic, enlarged perspective view of the dispenser shown in FIG. 3.

Referring now to the figures of the drawing in detail and first, particularly, to FIG. 1 thereof, there is shown a paper dispenser, in particular for toilet paper, that has a housing 1, which is provided with a non-illustrated front cover, which leaves a removal opening for paper 9 free at the bottom. Side walls 2 of the housing 1 are provided with guide tracks 6, into which paper rolls 10, 20 which are wound on roll carriers 3 and 4, and have in particular printing 18 on the outside, are inserted. The roll carriers 3 and 4 are provided, for this purpose, with protruding bearing journals 29, 30 (FIG. 10), which in particular are of different designs and can therefore only be inserted in the correct position into the likewise different guide tracks 6. The roll carriers 3, 4 have, close to the bearing journals 29, 30, crosspieces 26, 27 protruding up from the circumference 25, and so their diameter is greater in these regions than in a central region 28. Paper wound onto the roll carriers 3, 4 therefore lies, in the central region 28, not on the circumference 25 but at a slight distance 31 therefrom (FIG. 10). In FIG. 1, the dispenser is shown fully equipped, i.e. a dispensing roll 10 is located in a lower, dispensing position and a reserve roll 20 is located in an upper, standby position. Both positions are defined by a blocking device 7, 8, which is formed in each case by two-armed levers and are mounted on the side walls 2 such that they are able to rotate about axes 21 and 22. The free ends of the blocking devices 7, 8 are connected such that they can be displaced in an articulated manner, and so pivoting of one blocking device likewise pivots the other.

Furthermore, the paper dispenser contains a sensing element 11 for sensing the diameter of the dispensing roll 10, and in order for it to be possible to use paper provided with printing 18, has to be mounted in a pivotable manner on the front side of the dispenser, above the dispensing roll 10, in order to rest with dragging action on the paper 9, wherein the dispensing roll 10 also brakes in order to provide resistance when the paper is pulled off.

The sensing element 11 is arranged on a bracket, the side parts of which are formed by two-armed levers mounted on the side walls 2 such that they can pivot about an axis 19. The two lever arms 12, 13 extend approximately at right angles to one another and the sensing element 11 extends approximately parallel to the first lever arms 12 of the side parts, as can easily be seen in FIG. 2. At that end 32 of the sensing element 11 which rests on the paper roll, the sensing element is narrower than in the upper region, which is connected to the side parts. The length of the end 32 is somewhat shorter than the length of the central region 28 of the roll carrier 3, 4. Provided on the two first lever arms 12 of the two side parts is a pin 14, which engages in a curved slot 15 in one of the two blocking devices 7, 8—in the embodiment shown, the curved slot 15 is in the blocking device 8 for the dispensing roll 10. The first portion of the curved slot 15, starting from the bottom, is in the form of a circular arc and is concentric with the axis 19, and the second portion, which follows at the top, has a tighter curve and so draws closer to the axis 19.

Figure 2:
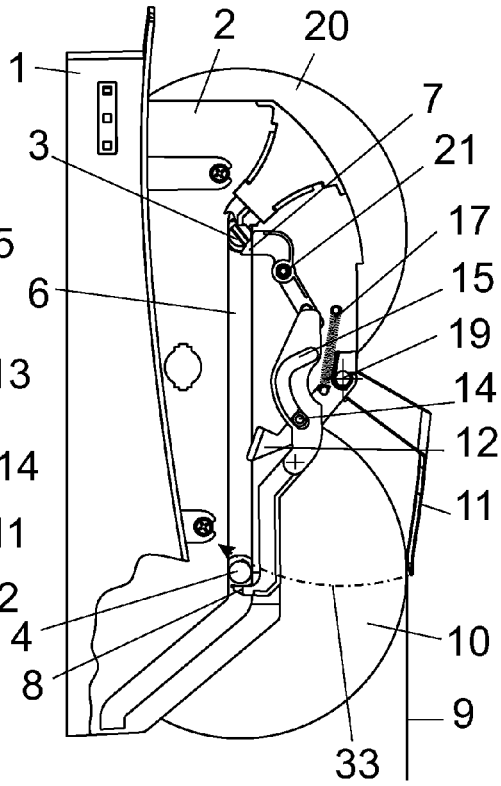
FIG. 2 is a side view of the dispenser in the first position during use.
Figure 3:
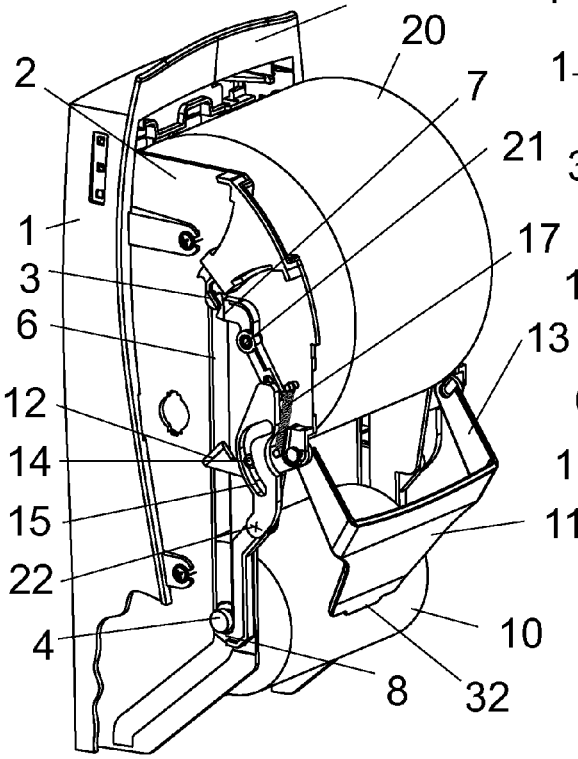
FIG. 3 is a perspective view of the dispenser in a second position during use.
Figure 4:
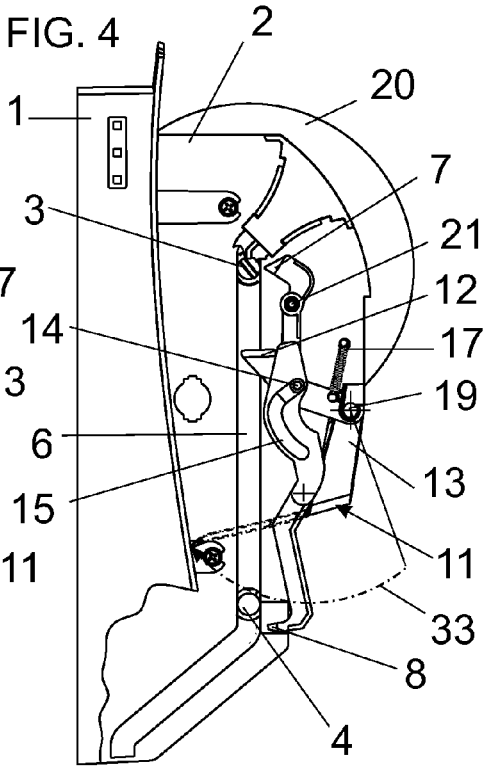
FIG. 4 is a side view of the dispenser in a third position during use.
Figure 5:
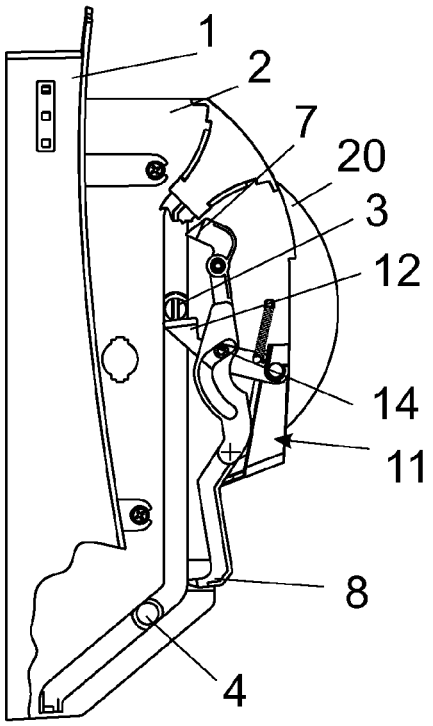
FIG. 5 is a side view of the dispenser in a fourth position during use.
Figure 6:
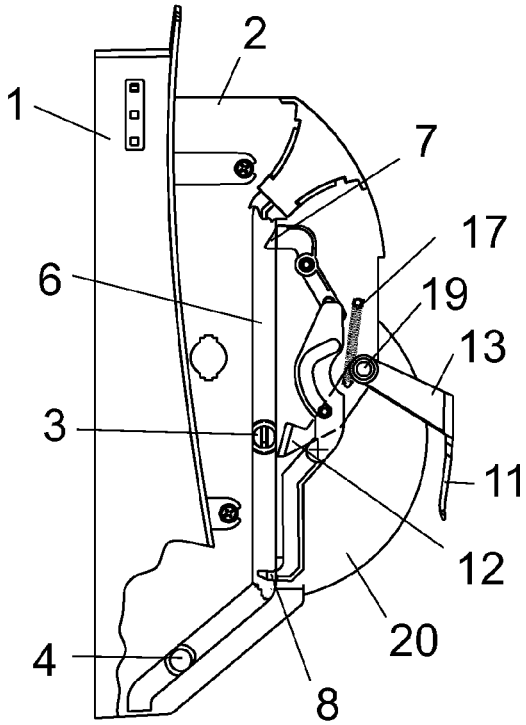
FIG. 6 is a side view of the dispenser in a fifth position during use.
Figure 7:
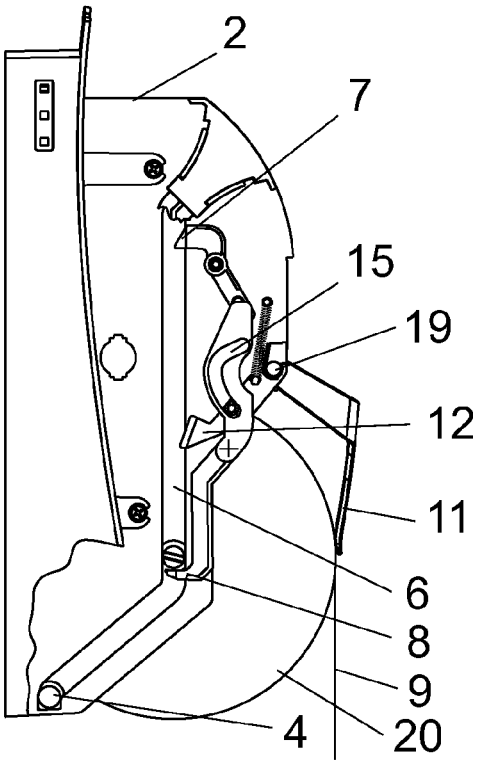
FIG. 7 is a side view of the dispenser in a sixth position during use.
Figure 8:
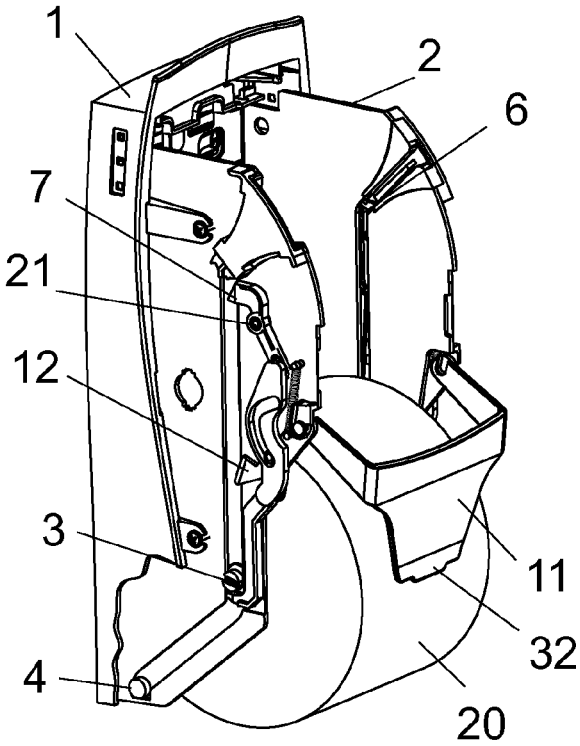
FIG. 8 is a perspective view of the dispenser in the sixth position.
Figure 9:
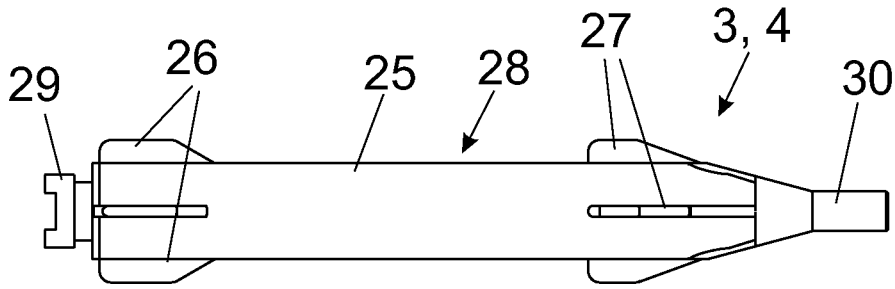
FIG. 9 is a diagrammatic, side view of a roll carrier.

The dispenser operates, then, as follows: out of the dispenser filled with two full rolls, as shown in FIG. 1 or 2, paper 9 is pulled by hand off the dispensing roll 10, the diameter of which decreases as a result. FIG. 3 shows a position in which the dispensing roll 10 is already significantly smaller. The sensing element 11 rests with dragging action on the dispensing roll 10, wherein a lightweight spring 17 assists the support, acting on a second lever arm 13 of a side part. When the sensing element 11 is pivoted downward along the circular arc 33, each pin 14 moves in the concentric portion of the slot 15, and so the coupled blocking device 7, 8, which grip beneath the roll carriers 3 and 4, are not moved. The end 32 of the sensing element 11 can pass into the gap 31 or into the central region 28 only when all the paper has been pulled off the roll carrier 3, and, as can be seen in FIG. 4 and FIG. 10, it can pivot down or back only after the dispensing roll 10 has been used up. In the process, the pin 14 has passed into the eccentric portion of the slot 15. In this portion, because the pin 14 of course cannot change its distance from the axis 19, the blocking devices 7, 8 are moved further away from the axis 19 and the ends pivot out of the guide tracks 2, and so both roll carriers 3, 4 lose their support and drop downward. The empty roll carrier 4 slides downward into an accommodating space, where it can then be removed. The full roll carrier 3, that is to say the reserve roll 20, drops downward in the guide tracks 2, although the ends of the first lever arms 12 are in the way (FIGS. 4, 5). The roll carrier 3 encounters the lever arms 12 and pivots them downward about the axis 19, and it pivots the sensing element 11 forward and upward again. The pins slide back again in the eccentric portion of the slot 15 and the blocking devices 7, 8 pivot into the guide track 2 again. The pins 14 here pass into the concentric first portion of the slots 15, and so, when the sensing element 11 pivots further into the position in which it is pivoted out to the full extent (FIG. 6) and subsequently returns to the position according to FIG. 7, they no longer move the blocking device 7, 8. As shown in FIG. 6, when the lever arms 12 are pivoted to the full extent, the sensing element 11 has been pivoted out far enough for the reserve roll 20 to pass by. Subsequently, the sensing element 11 returns, since the lever arms 12 are free again, and it rests on the circumference 25 of the new dispensing roll 10. A new reserve roll 20 can then be inserted into the dispenser, as shown in FIG. 8, and the state in FIG. 1 is re-established.

The invention claimed is:

1. A dispenser for dispensing paper from a dispensing roll located in a lower dispensing position, the dispenser comprising:

a blocking device;

a guide track which leads from a top into the lower dispensing position and in which a standby position, defined by said blocking device, for a reserve roll is provided;

a device for releasing said blocking device once the paper on the dispensing roll has been used up; and a device for detecting a diameter of the dispensing roll, said device having a sensing element resting against a circumferential surface of the dispensing roll in a sensing position, said blocking device and said device for releasing being interconnected with said sensing element, said sensing element being displaced by a dropping of the reserve roll for providing clearance between the reserve roll and said sensing element, said sensing element returning to the sensing position once the reserve roll has moved past the sensing element and dropped into the dispensing position.

2. The paper dispenser according to claim 1, wherein said device for releasing has a bracket with side parts formed from two-armed levers, said sensing element is disposed on said bracket, said two-armed levers each have a first lever arm protruding into said guide track and a second lever arm.

3. The paper dispenser according to claim 2, wherein said first and second lever arms are disposed approximately at right angles to one another.

4. The paper dispenser according to claim 2, wherein said first lever arm is coupled kinematically to said blocking device such that said blocking device withdraws from said guide track only in a second portion of a pivoting path of said sensing element.

5. The paper dispenser according to claim 4, wherein:

said blocking device has a curved slot formed therein; and said first lever arm has a pin engaging in said curved slot in said blocking device, said curved slot having a first portion extending concentrically with respect to a pivot axis of said sensing element and a subsequent, second portion extending eccentrically with respect thereto.

6. The paper dispenser according to claim 5, wherein said second portion of said curved slot draws closer to said pivot axis.

7. The paper dispenser according to claim 1, further comprising a further, releasable blocking device for defining the lower dispensing position of the dispensing roll and interacts with said first lever arm.

8. The paper dispenser according to claim 1, further comprising an external indicator for a roll change and said external indicator being activated by the dropping of the reserve roll.

* * * * *